US011458529B2

(12) United States Patent
Chuang

(10) Patent No.: US 11,458,529 B2
(45) Date of Patent: Oct. 4, 2022

(54) CHAIN TOOL

(71) Applicant: Louis Chuang, Taichung (TW)

(72) Inventor: Louis Chuang, Taichung (TW)

( * ) Notice: Subject to any disclaimer, the term of this patent is extended or adjusted under 35 U.S.C. 154(b) by 403 days.

(21) Appl. No.: 16/736,387

(22) Filed: Jan. 7, 2020

(65) Prior Publication Data

US 2020/0338628 A1 Oct. 29, 2020

(30) Foreign Application Priority Data

Apr. 23, 2019 (TW) ..... 108114096

(51) Int. Cl.

| | |
|---|---|
| ***B21L 9/06*** | (2006.01) |
| ***B21L 9/04*** | (2006.01) |
| ***B21L 21/00*** | (2006.01) |
| ***B25B 27/02*** | (2006.01) |
| ***B25B 27/22*** | (2006.01) |

(52) U.S. Cl.

CPC ..... *B21L 9/065* (2013.01); *B21L 9/04* (2013.01); *B21L 21/00* (2013.01); *B25B 27/02* (2013.01); *B25B 27/023* (2013.01); *B25B 27/22* (2013.01)

(58) Field of Classification Search

CPC ..... B25B 27/22; B25B 27/023; B25B 27/08; B25B 27/0071; B25G 1/08; F16G 3/006; B21L 9/065; B21L 9/04

USPC ..... 81/440, 439, 438, 437; 29/237; 59/7

See application file for complete search history.

(56) References Cited

U.S. PATENT DOCUMENTS

| | | | |
|---|---|---|---|
| 6,019,352 | A | 2/2000 | Mayer |
| 7,082,747 | B2 | 8/2006 | Oishi et al. |
| 7,343,728 | B1 | 3/2008 | Cundari |
| 8,186,745 | B2 | 5/2012 | Seiter et al. |
| 10,035,248 | B2 | 7/2018 | Ichikawa |
| 10,408,301 | B2 | 9/2019 | Lauer |
| 2006/0219063 | A1 | 10/2006 | Takamatsu |
| 2010/0307126 | A1 | 12/2010 | Seiter et al. |
| 2012/0118115 | A1 | 5/2012 | Huang |
| 2019/0047127 | A1 | 2/2019 | Ichikawa |

FOREIGN PATENT DOCUMENTS

| | | |
|---|---|---|
| CN | 102101152 A | 6/2011 |
| CN | 206677105 U | 11/2017 |
| CN | 207432130 U | 6/2018 |

(Continued)

OTHER PUBLICATIONS

Translation of DE1141860, retrieved from Espacenet on Apr. 6, 2022 (Year: 1962).*

*Primary Examiner* — Orlando E Aviles
*Assistant Examiner* — Thomas Raymond Rodgers
(74) *Attorney, Agent, or Firm* — Alan D. Kamrath; Karin L. Williams; Mayer & Williams PC

(57) ABSTRACT

A chain tool includes a body having a driving hole, a stop portion, and a receiving portion located between the driving hole and the stop portion in an axial direction. A pressing member is received in the receiving portion and is movable relative to the body in the axial direction. A push member is in threading connection with the first threaded portion and is movable relative to the body between a first position distant to the stop portion and a second position adjacent to the stop portion. The pressing member is pressed by the push member and moves in an arcuate path when the push member moves between the first and second positions.

7 Claims, 11 Drawing Sheets

(56) References Cited

FOREIGN PATENT DOCUMENTS

| | | | | |
|---|---|---|---|---|
| CN | 108291607 | A | | 7/2018 |
| CN | 208961909 | U | | 6/2019 |
| DE | 924440 | C | | 3/1955 |
| DE | 1141860 | | * | 12/1962 |
| DE | 8810263 | U1 | | 11/1988 |
| DE | 202016104230 | U1 | | 8/2016 |
| JP | H079360 | A | | 1/1995 |
| SU | 664812 | A1 | | 5/1979 |
| TW | 262790 | | | 11/1995 |
| TW | I381913 | B | | 1/2013 |
| TW | I461265 | B | | 11/2014 |
| TW | I569928 | B | | 2/2017 |
| TW | M554399 | U | | 1/2018 |
| TW | I630960 | B | | 8/2018 |

* cited by examiner

CHAIN TOOL

BACKGROUND OF THE INVENTION

The present invention relates to a chain tool and, more particularly, to an arcuate chain tool.

PCT/EP2015/071492 discloses a device for actuating a quick release chain fastener comprising two chain link plates and two chain link plate connection means. The quick release chain fastener is actuatable in that the chain link plate connection means are moved in relation to each other. The device comprises first force exertion means configured to exert a force on the first chain link plate connection means of the quick release chain fastener and second force exertion means configured to exert a force on the second chain link plate connection means of the quick release chain fastener. The first and second force exertion means are translationally moveable in relation to each other so as to actuate the quick release chain fastener by means of this translational movement.

However, the above device can only be used on a quick release chain fastener having an elongated slot extending rectilinearly. There are another type of quick release chain fastener having an arcuate elongated slot. Thus, the operation could not be smooth when the above device is used on the quick release chain fastener having an arcuate elongated slot.

Thus, a need exists for an arcuate chain tool that overcomes the disadvantages of the above conventional device.

BRIEF SUMMARY OF THE INVENTION

The present invention provides a chain tool including a body and a push unit. The body includes a receiving portion, a driving hole, and a stop portion. The receiving portion is located between the driving hole and the stop portion in an axial direction of the driving hole. The driving hole includes an end intercommunicating with the receiving portion and a first threaded portion therein. The push unit includes a pressing member and a push member. The pressing member is received in the receiving portion and is movable relative to the body in the axial direction. The push member includes a second threaded portion in threading connection with the first threaded portion. The push member is movable between a first position and a second position relative to the body in the axial direction. The push member presses against the pressing member to push the pressing member to move together with the push member. The pressing member moves in an arcuate path when the push member moves between the first and second positions, wherein the pressing member is in a position distant to the stop portion when the push member is in the first position. The pressing member is in a position adjacent to the stop portion when the push member is in the second position.

In an embodiment, the body further includes a back board. The receiving portion, the driving hole, and the stop portion are on the same side of the back board. The pressing member includes a rocker arm pivotably connected to the back board about a pivotal axis perpendicular to the back board.

In an example, the pivotal axis passes through an end of the rocker arm opposite to the pressing member. A fastener extends through a hole in the end of the rocker arm and is in threading connection with the back board.

In an example, the back board includes a side facing the receiving portion and having a groove. An elastic element is received in the groove and includes a first end attached to the back board and a second end abutting against a side of the pressing member opposite to the push member.

In an example, the elastic element is a substantially V-shaped plate.

In another embodiment, the body further includes a back board. The receiving portion, the driving hole, and the stop portion are on the same side of the back board. The pressing member includes a sliding seat. The sliding seat is slidably disposed on the back board and is movable relative to the body along the arcuate path.

In an example, the back board includes a side facing the receiving portion and having a sliding groove. The sliding seat is disposed in the sliding groove. The sliding groove and the sliding seat are arcuate. The pressing member protrudes beyond the sliding groove.

In an example, the sliding groove includes a positioning protrusion protruding from a wall thereof and receives an elastic element. The sliding seat has a slot. The positioning protrusion and the elastic element are received in the slot. The elastic element includes a first end abutting against the positioning protrusion and a second end abutting against an inner wall of the slot adjacent to the push member.

In an example, a cover is disposed on the body, covers the sliding groove, and is located on a side of the sliding seat opposite to the back board. A fastener extends through the cover and is in threading connection with the positioning protrusion.

The present invention will become clearer in light of the following detailed description of illustrative embodiments of this invention described in connection with the drawings.

DETAILED DESCRIPTION OF THE INVENTION

Figure 1:
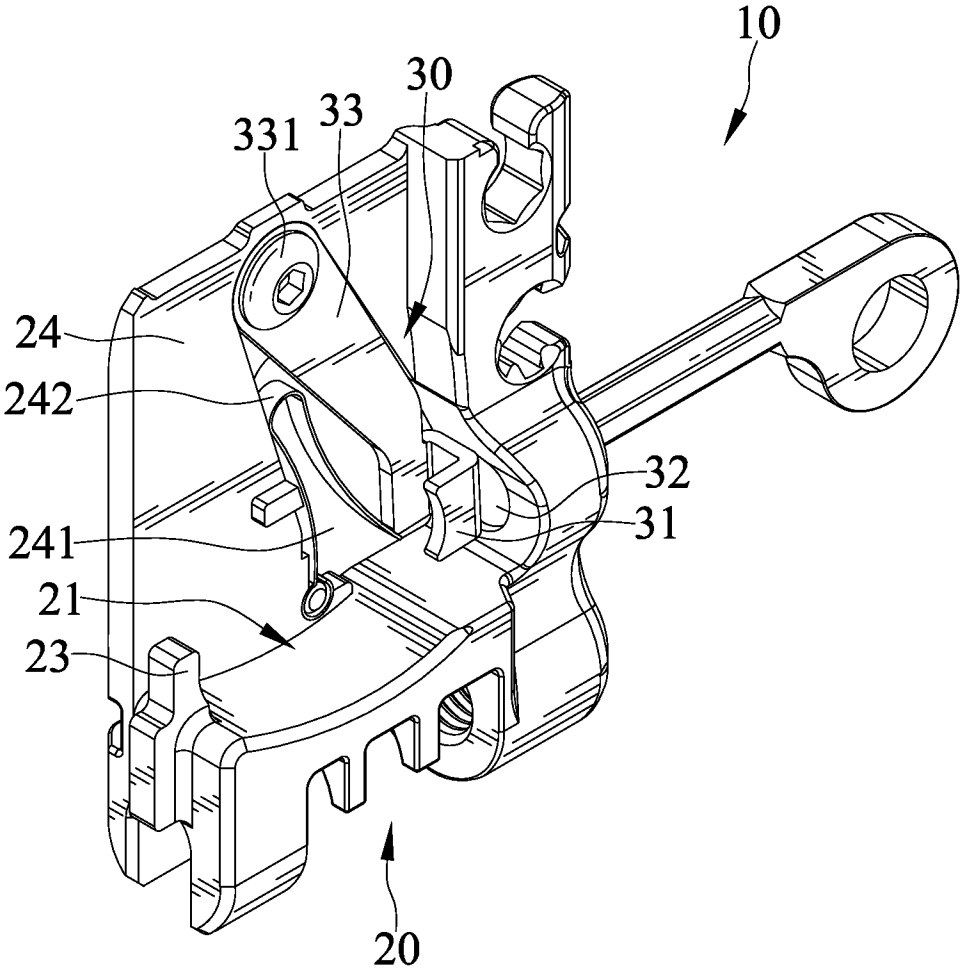
FIG. 1 is a perspective view of a chain tool of a first embodiment according to the present invention.
Figure 2:
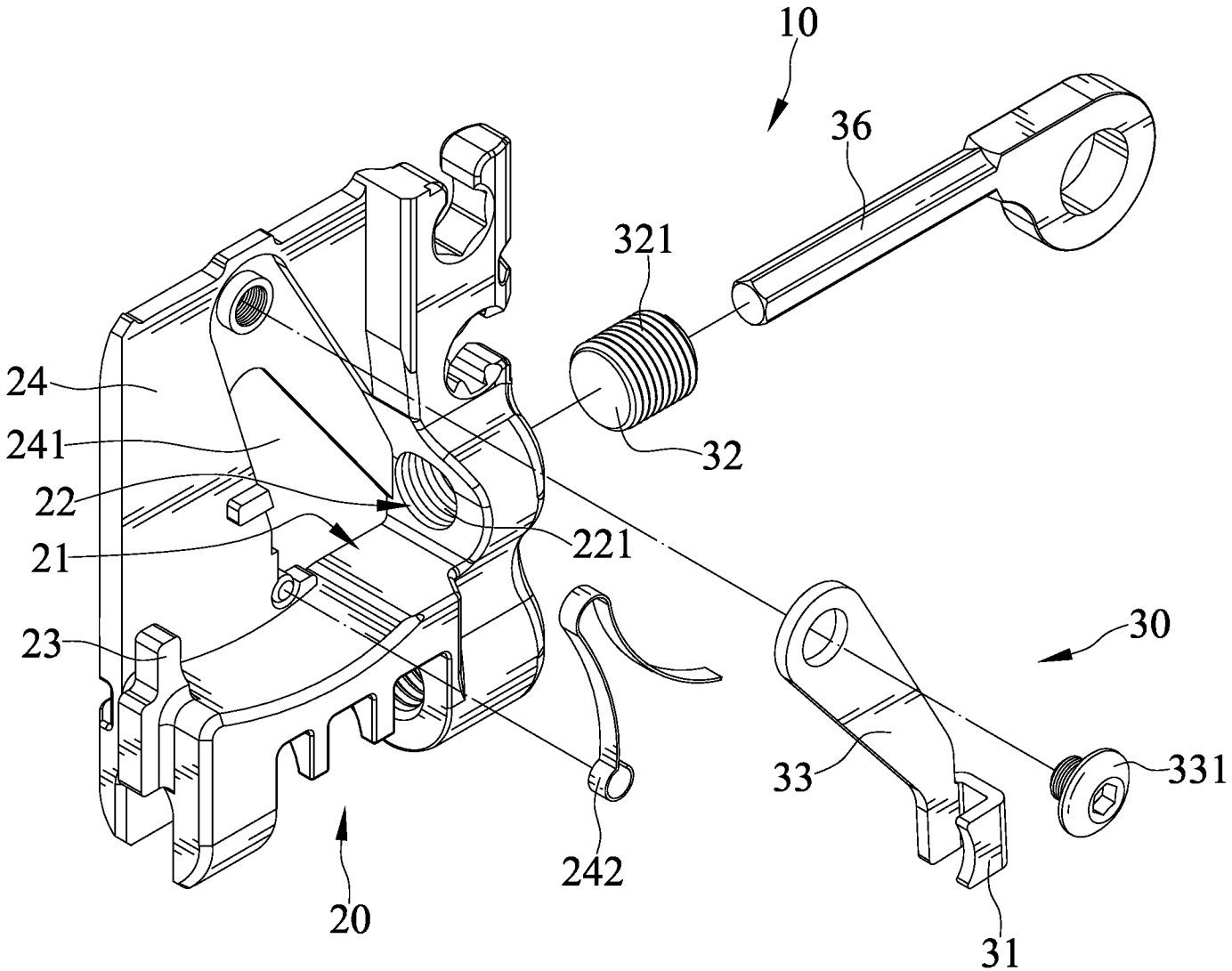
FIG. 2 is an exploded, perspective view of the chain tool of FIG. 1.
Figure 3:
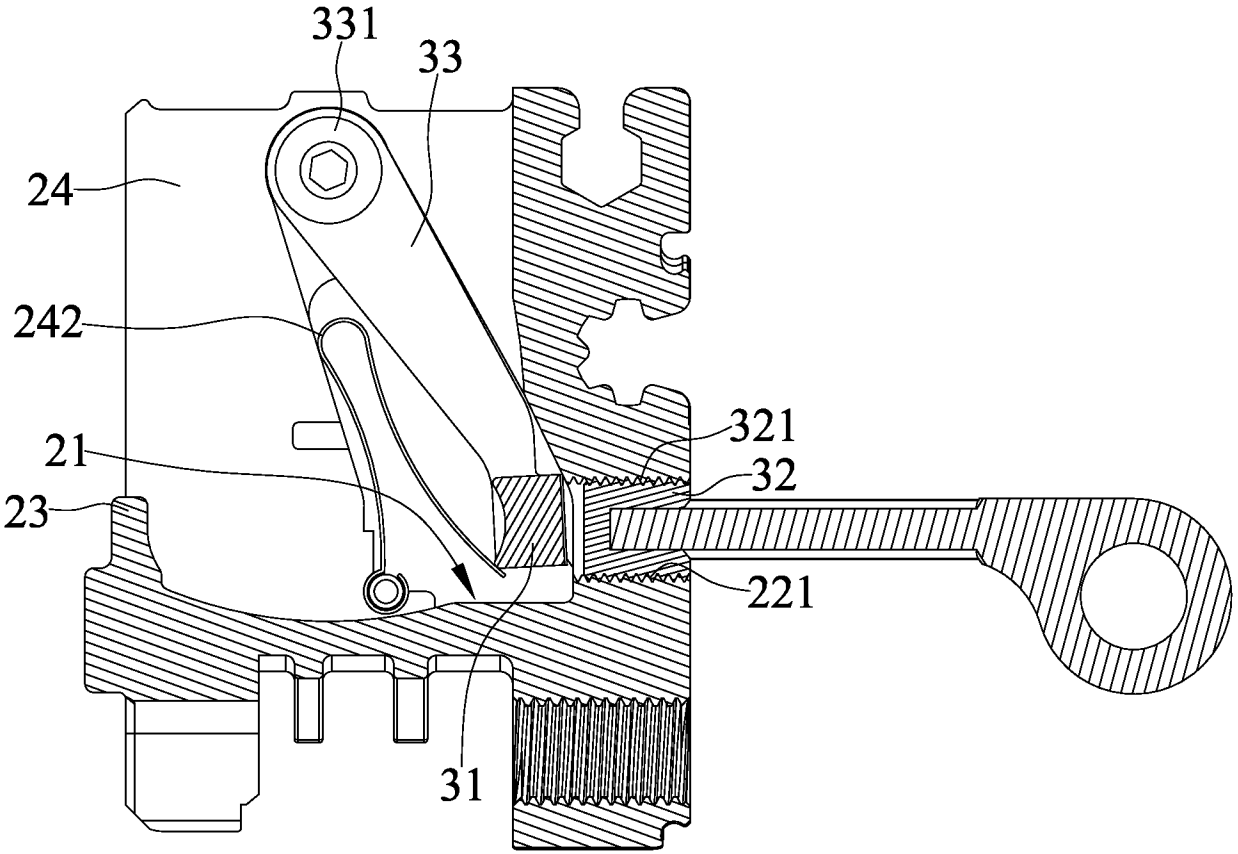
FIG. 3 is a cross sectional view of the chain tool of FIG. 1 with a push member in a first position.
Figure 4:
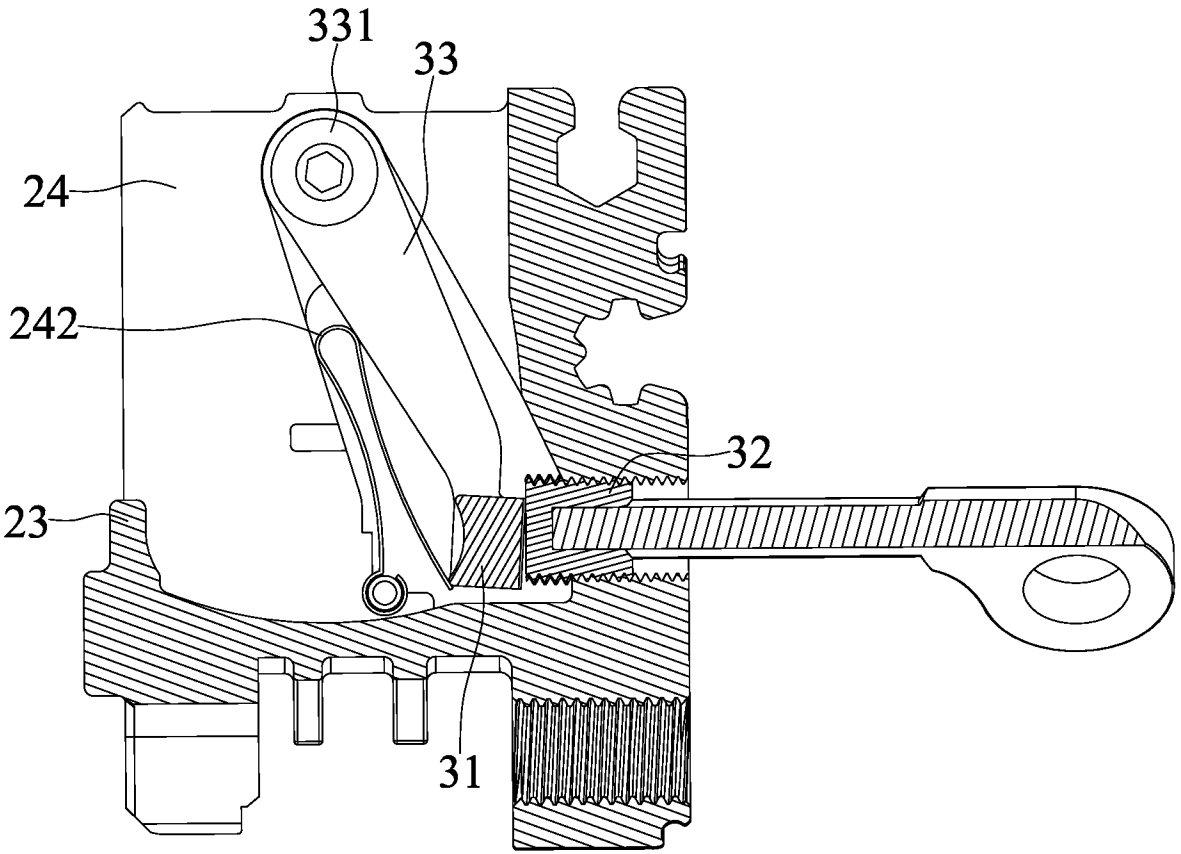
FIG. 4 is a cross sectional view of the chain tool of FIG. 1 with the push member in a second position.
Figure 5:
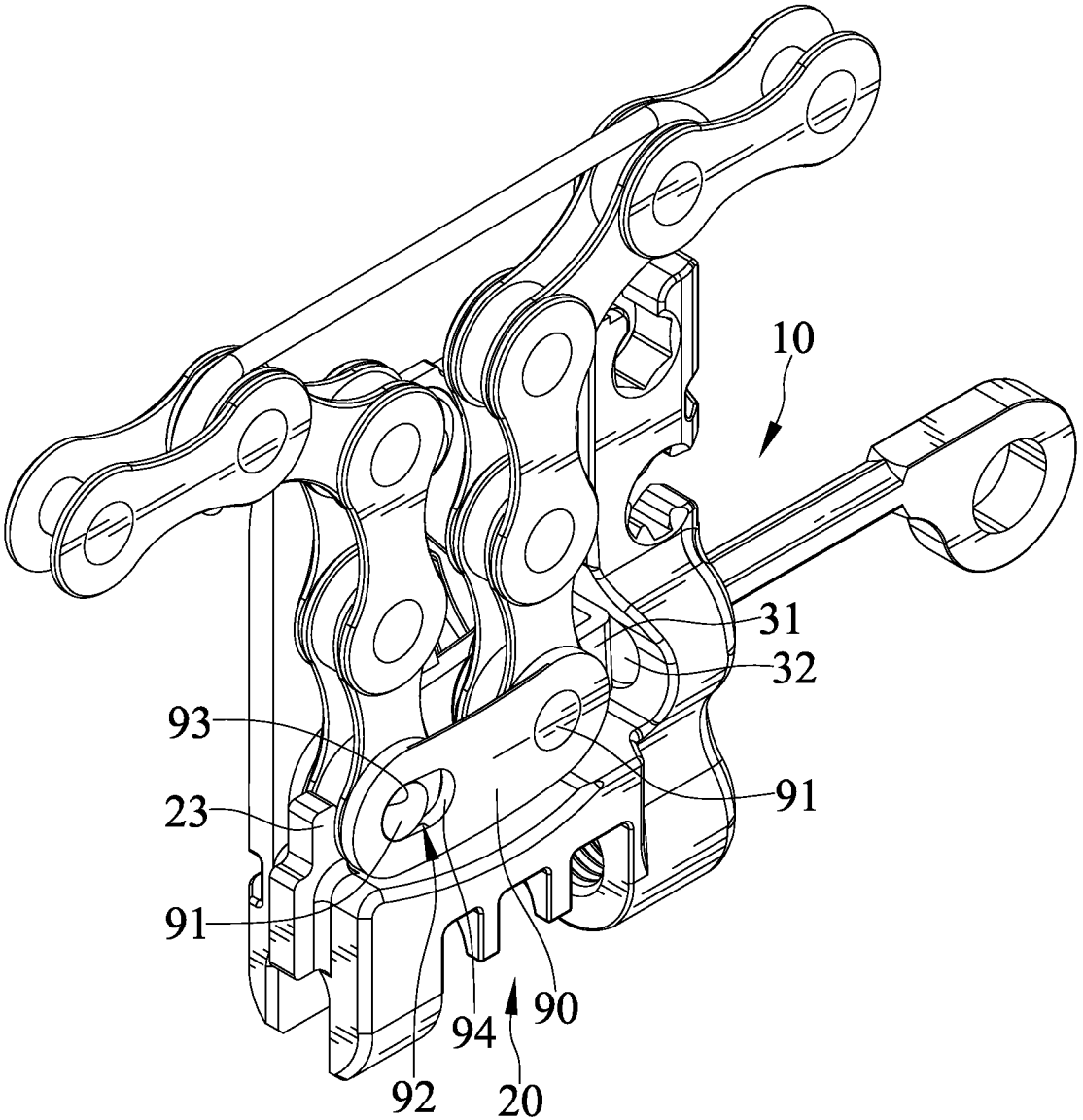
FIG. 5 is a perspective view illustrating use of the chain tool of FIG. 1.

With reference to FIGS. 1-4, a chain tool 10 of a first embodiment according to the present invention includes a body 20 and a push unit 30. The body 20 has a receiving portion 21, a driving hole 22, and a stop portion 23. The receiving portion 21 is located between the driving hole 22 and the stop portion 23 in an axial direction of the driving hole 22. The driving hole 22 includes an end intercommunicating with the receiving portion 21. The driving hole 22 further has a first threaded portion 221 therein.

The push unit 30 includes a pressing member 31 and a push member 32. The pressing member 31 is received in the receiving portion 21 and is movable relative to the body 20 in the axial direction. The push member 32 includes a second threaded portion 321 in threading connection with the first threaded portion 221. The push member 32 is movable between a first position and a second position relative to the body 20 in the axial direction. The push member 32 presses against the pressing member 31 to push the pressing member 31 to move together with the push member 32. The pressing member 31 moves in an arcuate path when the push member 32 moves between the first and second positions. In this embodiment, the push member 32 is coupled with a hand tool 36 extending beyond the other end of the driving hole 22. Thus, the hand tool 36 can be manually rotated to move the push member 32 between the first and second positions.

Figure 6:
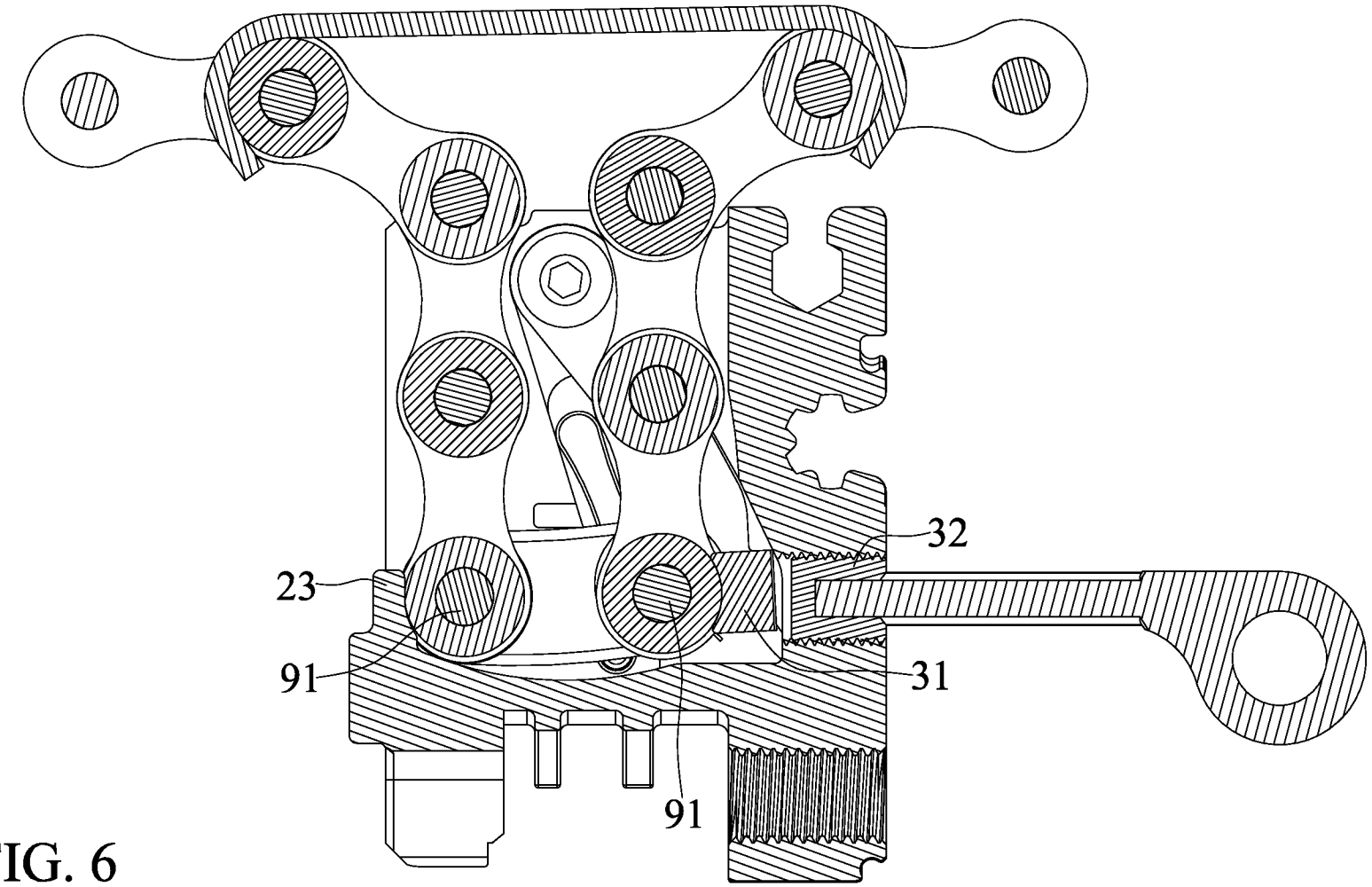
FIG. 6 is a cross sectional view illustrating use of the chain tool with the push member in the first position.
Figure 7:
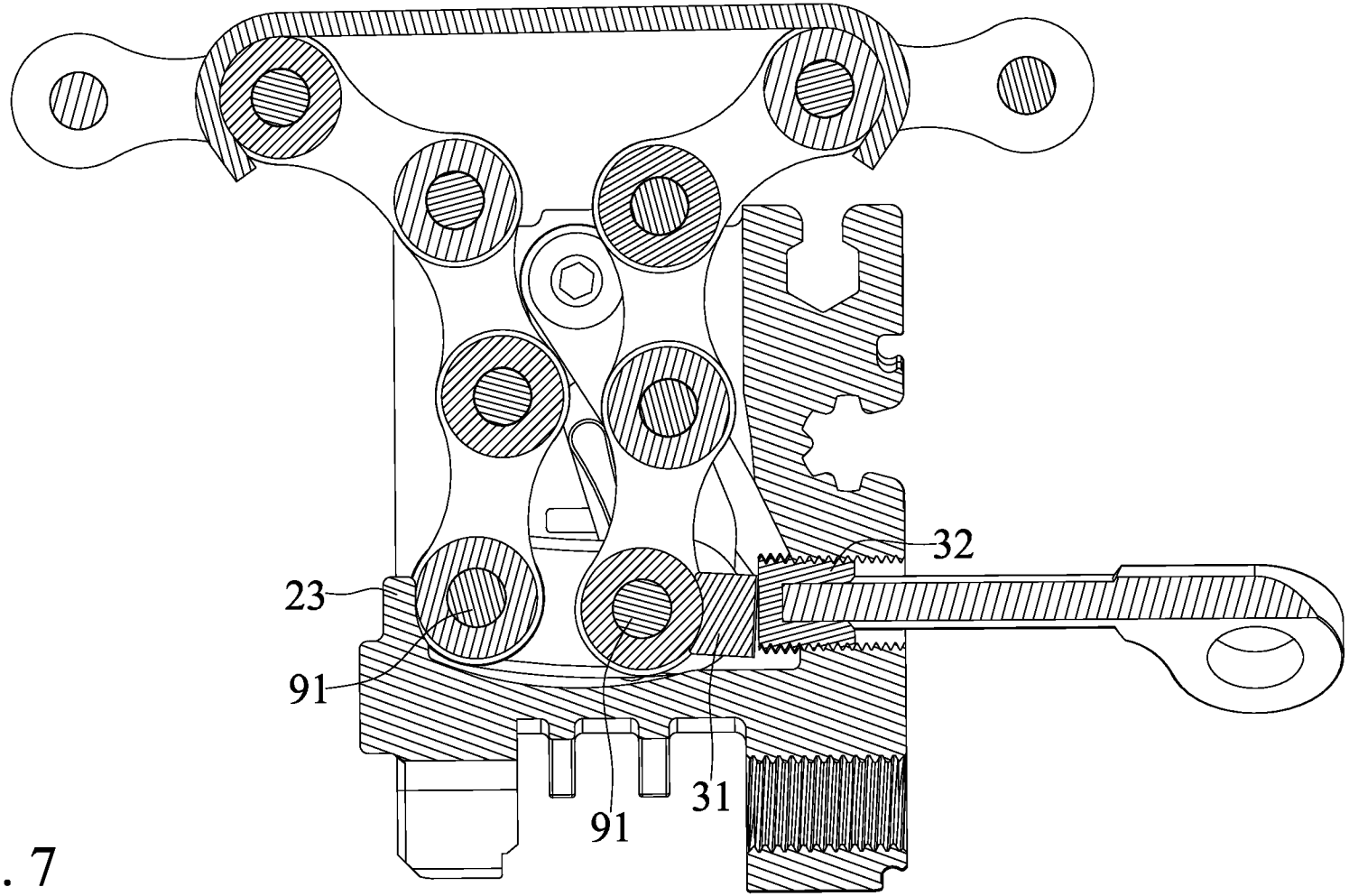
FIG. 7 is a view similar to FIG. 6 with the push member moved to the second position.
Figure 8:
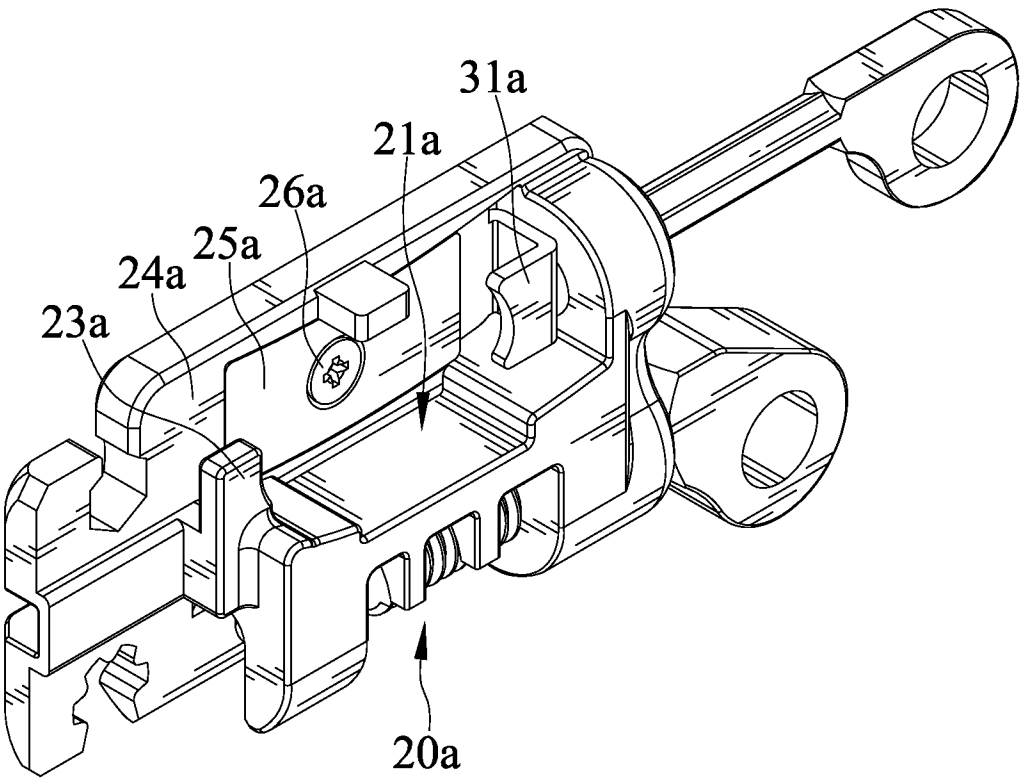
FIG. 8 is a perspective view of a chain tool of a second embodiment according to the present invention.
Figure 9:
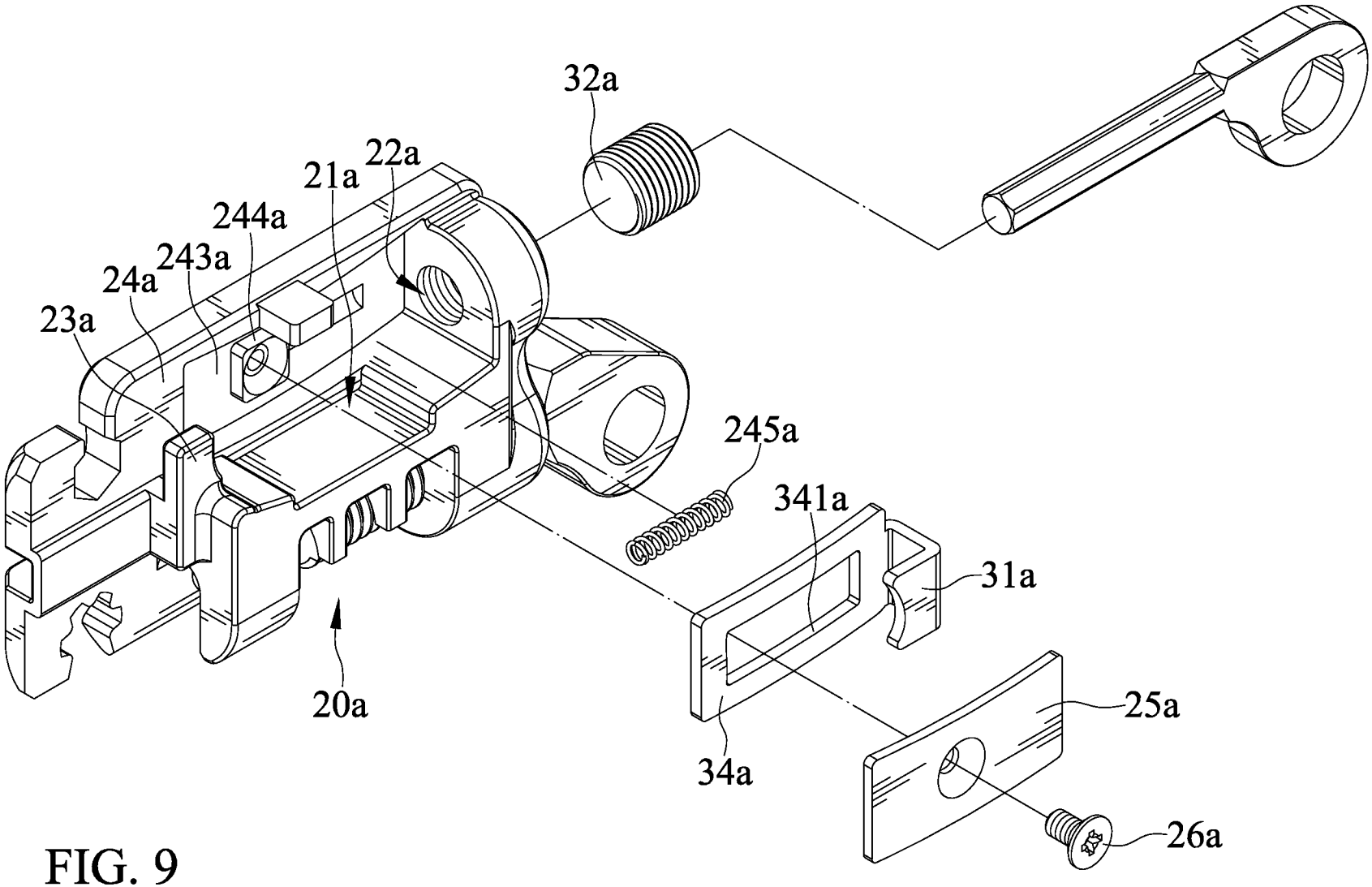
FIG. 9 is an exploded, perspective view of the chain tool of FIG. 8.
Figure 10:
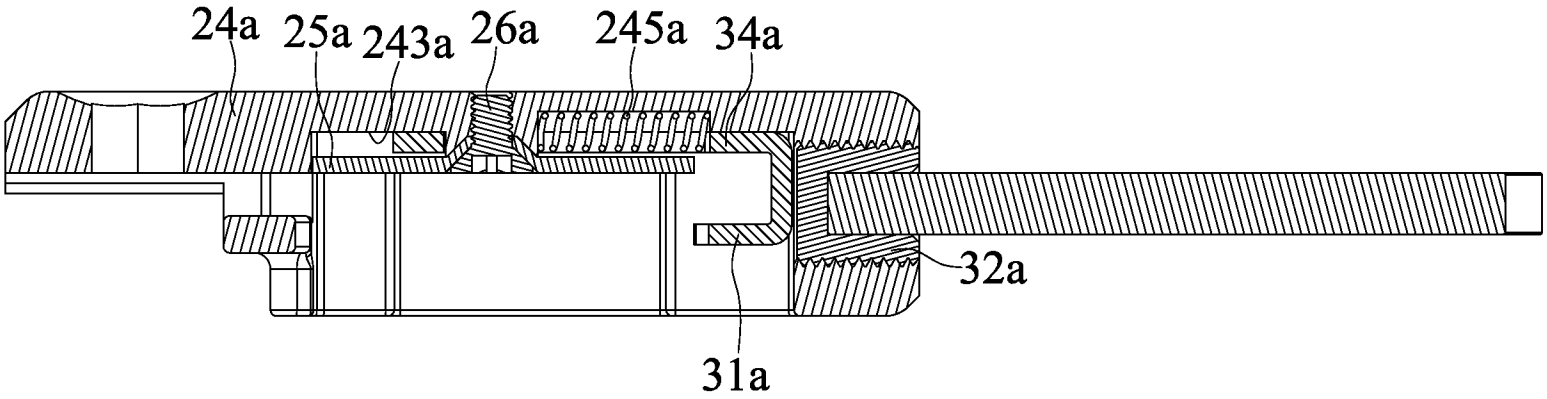
FIG. 10 is a cross sectional view of the chain tool of FIG. 8.
Figure 11:
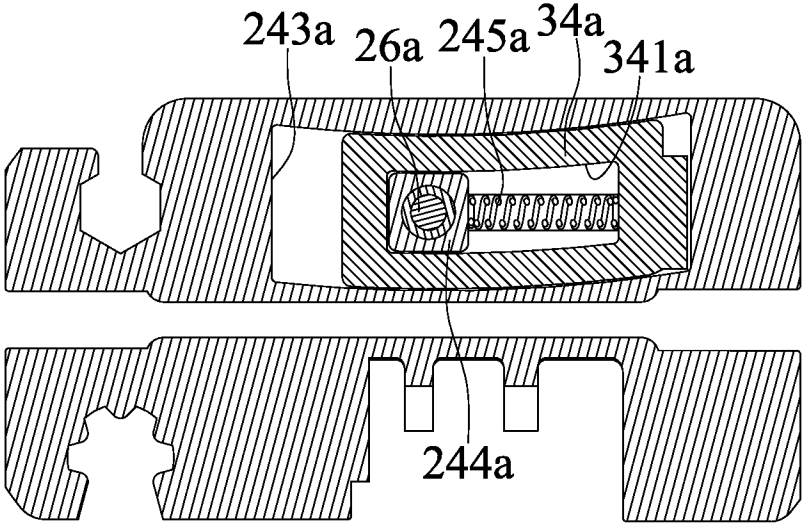
FIG. 11 is another cross sectional view of the chain tool of FIG. 8.

The pressing member 31 is in a position distant to the stop portion 23 when the push member 32 is in the first position, as shown in FIG. 6. The pressing member 31 is in a position adjacent to the stop portion 23 when the push member 32 is in the second position, as shown in FIG. 7.

The body 20 further includes a back board 24. The receiving portion 21, the driving hole 22, and the stop portion 23 are on the same side of the back board 24. The pressing member 31 includes a rocker arm 33 pivotably connected to the back board 24 about a pivotal axis perpendicular to the back board 24. The pivotal axis passes through an end of the rocker arm 33 opposite to the pressing member 31. A fastener 331 extends through a hole in the end of the rocker arm 33 and is in threading connection with the back board 24. Thus, the rocker arm 33 and the pressing member 31 pivot about the pivotal axis when the push member 32 moves between the first and second positions.

The back board 24 includes a side facing the receiving portion 21 and having a groove 241. An elastic element 242 is received in the groove 241 and includes a first end attached to the back board 24 and a second end abutting against a side of the pressing member 31 opposite to the push member 32. The elastic element 242 is a substantially V-shaped plate in this embodiment.

The chain tool 10 can be used on a pair of quick coupling chain links 90 (also known as quick release chain links) each having an arcuate elongated slot 92. Each arcuate elongated slot 92 has a smaller portion 93 and a larger portion 94. The stop portion 23 and the pressing member 31 press against two pins 91 coupled with the pair of quick coupling chain links 90, respectively. When the push member 32 is moved to the second position shown in FIG. 7, the pressing member 31 presses against one of the two pins 91 (the right pin 91 in FIG. 7), such that the other pin 91 (the left pin 91 in FIG. 7) moves from the smaller portion 93 to the larger portion 94 of each arcuate elongated slot 92, permitting quick release of an end of the pair of quick coupling chain links 90 from the left pin 91.

FIGS. 8-11 show a chain tool 10 of a second embodiment according to the present invention. The second embodiment is substantially the same as the first embodiment except for that the body 20*a* includes a back board 24*a*. The receiving portion 21*a*, the driving hole 22*a*, and the stop portion 23*a* are on the same side of the back board 24*a*. The pressing member 31*a* includes a sliding seat 34*a*. The sliding seat 34*a* is slidably disposed on the back board 24*a* and is movable relative to the body 20*a* along the arcuate path.

The back board 24*a* includes a side facing the receiving portion 21*a* and having a sliding groove 243*a*. The sliding seat 34*a* is disposed in the sliding groove 243*a*. The sliding groove 243*a* and the sliding seat 34*a* are arcuate. The pressing member 31*a* protrudes beyond the sliding groove 243*a*. The sliding groove 243*a* includes a positioning protrusion 244*a* protruding from a wall thereof and receives an elastic element 245*a*. The sliding seat 34*a* has a slot 341*a*. The positioning protrusion 244*a* and the elastic element 245*a* are received in the slot 341*a*. The elastic element 245*a* includes a first end abutting against the positioning protrusion 244*a* and a second end abutting against an inner wall of the slot 341*a* adjacent to the push member 32*a*.

A cover 25*a* is disposed on the body 20*a*, covers the sliding groove 243*a*, and is located on a side of the sliding seat 34*a* opposite to the back board 24*a*. A fastener 26*a* extends through the cover 25*a* and is in threading connection with the positioning protrusion 244*a*.

Operation of the second embodiment is substantially the same as that of the first embodiment and, thus, will not be described to avoid redundancy. In view of the foregoing, the chain tool 10 according to the present invention can be used to rapidly detach the pair of quick coupling chain links 90 with arcuate elongated slots 92 from the associated pin 91.

Although specific embodiments have been illustrated and described, numerous modifications and variations are still possible without departing from the scope of the invention. The scope of the invention is limited by the accompanying claims.

The invention claimed is:

1. A chain tool comprising:

a body including a receiving portion, a driving hole, a stop portion, and a back board, wherein the receiving portion is located between the driving hole and the stop portion in an axial direction of the driving hole, wherein the driving hole includes an end intercommunicating with the receiving portion and a first threaded portion therein; and a push unit including a pressing member and a push member, wherein the pressing member is received in the receiving portion and is movable relative to the body in the axial direction, wherein the push member includes a second threaded portion in threading connection with the first threaded portion, wherein the push member is movable between a first position and a second position relative to the body in the axial direction, wherein the push member presses against the pressing member to push the pressing member to move together with the push member, wherein the pressing member moves in an arcuate path when the push member moves between the first and second positions, wherein the pressing member is in a position distant to the stop portion when the push member is in the first position, wherein the pressing member is in a position adjacent to the stop portion when the push member is in the second position, wherein a pivotal axis passes through an end of a rocker arm opposite to the pressing member, and wherein a fastener extends through a hole in the end of the rocker arm and is in threading connection with the back board.

2. The chain tool as claimed in claim 1, wherein the receiving portion, the driving hole, and the stop portion are on a same side of the back board, wherein the pressing member includes the rocker arm pivotably connected to the back board about the pivotal axis perpendicular to the back board.

3. The chain tool as claimed in claim 1, comprising:

wherein the back board includes a side facing the receiving portion and having a groove, wherein an elastic element is received in the groove and is a substantially V-shaped plate.

4. The chain tool as claimed in claim 3, wherein the elastic element includes a first end attached to the back board and a second end abutting against a side of the pressing member opposite to the push member.

5. A chain tool comprising:

a body including a receiving portion, a driving hole, a stop portion, and a back board, wherein the receiving portion is located between the driving hole and the stop portion in an axial direction of the driving hole, wherein the driving hole includes an end intercommunicating with the receiving portion and a first threaded portion therein, wherein the receiving portion, the driving hole, and the stop portion are on a same side of the back board; and a push unit including a pressing member and a push member, wherein the pressing member is received in the receiving portion and is movable relative to the body in the axial direction, wherein the push member includes a second threaded portion in threading connection with the first threaded portion, wherein the push member is movable between a first position and a second position relative to the body in the axial direction, wherein the push member presses against the pressing member to push the pressing member to move together with the push member, wherein the pressing member moves in an arcuate path when the push member moves between the first and second positions, wherein the pressing member is in a position distant to the stop portion when the push member is in the first position, wherein the pressing member is in a position adjacent to the stop portion when the push member is in the second position, wherein the pressing member includes a sliding seat, wherein the sliding seat is slidably disposed on the back board and is movable relative to the body along the arcuate path, wherein the back board includes a side facing the receiving portion and having a sliding groove, wherein the sliding seat is disposed in the sliding groove, wherein the sliding groove and the sliding seat are arcuate, and wherein the pressing member protrudes beyond the sliding groove.

6. The chain tool as claimed in claim 5, wherein the sliding groove includes a positioning protrusion protruding from a wall thereof and receives an elastic element, wherein the sliding seat has a slot, wherein the positioning protrusion and the elastic element are received in the slot, and wherein the elastic element includes a first end abutting against the positioning protrusion and a second end abutting against an inner wall of the slot adjacent to the push member.

7. The chain tool as claimed in claim 6, wherein a cover is disposed on the body, covers the sliding groove, and is located on a side of the sliding seat opposite to the back board, and wherein a fastener extends through the cover and is in threading connection with the positioning protrusion.

* * * * *